US006837078B1

(12) United States Patent
Rock et al.

(10) Patent No.: US 6,837,078 B1
(45) Date of Patent: Jan. 4, 2005

(54) KNIT FABRICS WITH FACE-TO-BACK DIFFERENTIATION

(75) Inventors: Moshe Rock, Brookline, MA (US); Gadalia Vainer, Melrose, MA (US); Charles Haryslak, Marlborough, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 0 days.

(21) Appl. No.: 10/823,813

(22) Filed: Apr. 13, 2004

(51) Int. Cl.[7] ..... D04B 21/00
(52) U.S. Cl. ..... 66/195
(58) Field of Search ..... 66/194, 195, 196

(56) References Cited

U.S. PATENT DOCUMENTS 3,921,418 A * 11/1975 Apken ..... 66/87
4,302,953 A * 12/1981 Wilkens ..... 66/87
4,315,419 A * 2/1982 Kernbichler et al. ..... 66/87
4,712,281 A * 12/1987 Scheller ..... 66/194
5,855,125 A 1/1999 Lohmueller et al.
6,199,410 B1 3/2001 Rock et al.

* cited by examiner

*Primary Examiner*—Danny Worrell
(74) *Attorney, Agent, or Firm*—Fish & Richardson P.C.

(57) ABSTRACT

A double face knit fabric has a technical face with a velour or fleece surface and a first set of appearance characteristics and a technical back with a velvet surface and a second set of appearance characteristics. The first set of appearance characteristics is different from the second set of appearance characteristics. Pile yarns are processed by napping or raising to form the velour or fleece surface at the technical face and the pile yarns are processed to form the velvet surface at the technical back. The pile yarns include first yarns formed of materials having the first set of appearance characteristics selected from the group of consisting of: depth of color upon dyeing, degree of raising, degree of air permeability, susceptibility to selected dye formulation, reaction to heat, and degree of coarseness, bulk, cross-section and/or denier and second pile yarns formed of materials having the second set of appearance characteristics selected from among the group of consisting of: depth of color upon dyeing, degree of fiber straightness, degree of fiber curl, degree of fiber shrinkage, degree of fiber crimp degree of raising, reaction to heat, degree of yarn coarseness, bulk, cross-section and/or denier.

37 Claims, 7 Drawing Sheets

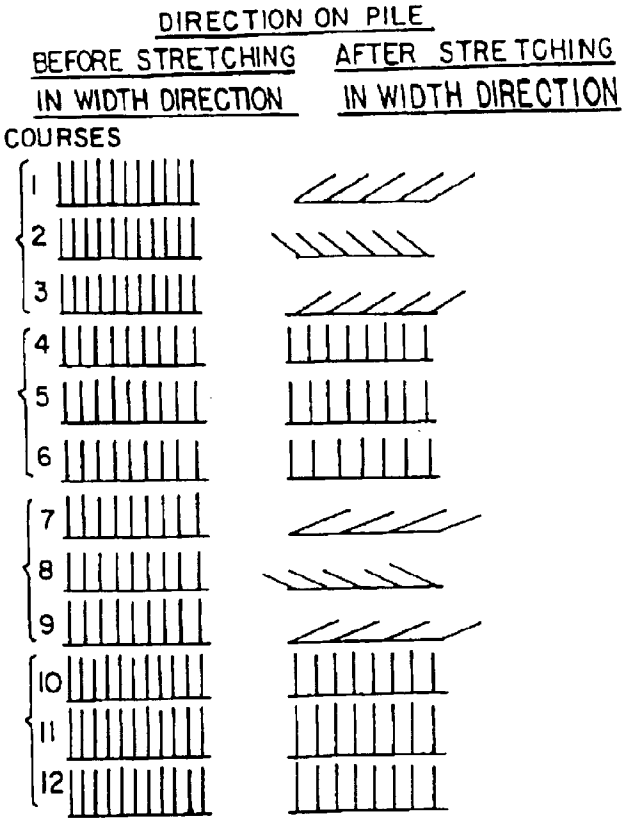
FIG.8B
FIG.8C
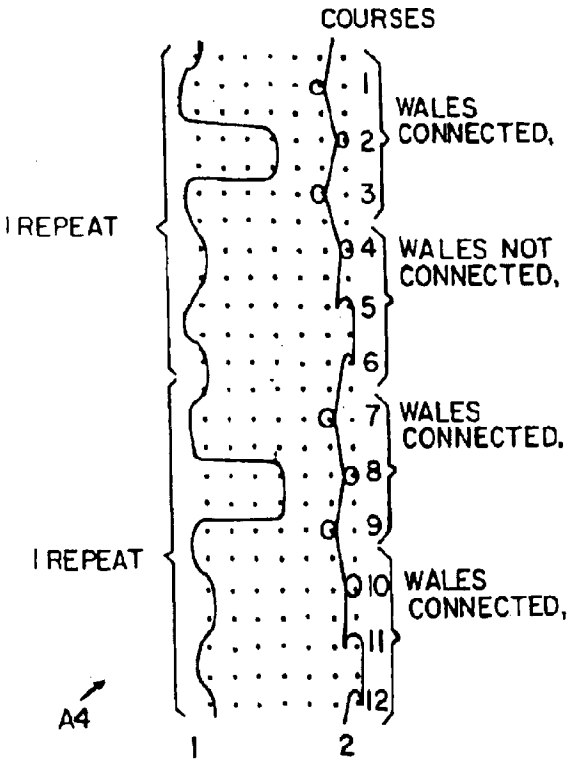
FIG.8A

KNIT FABRICS WITH FACE-TO-BACK DIFFERENTIATION

TECHNICAL FIELD

This invention relates to knit fabrics in which the technical face and technical back are both raised, and the technical face has an appearance different from the appearance of the technical back.

BACKGROUND

Warp knitting machines are well known for use in the manufacture of knitted fabrics. For instance, a three-dimensional knit fabric may be knitted on a machine having two needle beds with multiple guide bars. Two warp knit fabrics are formed from pile yarns, stitch yarns and backing yarns, with the pile yarns (also referred to as the connecting yarns) connecting the two fabrics. After knitting, the fabrics are split into two pieces of fabric by cutting the connecting yarns. Each of the two resulting pieces of fabric has a flat knit surface on one side (the technical face) and a pile surface on the other side (the technical back), formed by the cut interconnecting yarns[1]. In some cases, the technical back is brushed to form a velvet surface, and the technical face remains unfinished. When such fabrics are used in garments, a lining is provided adjacent the technical face to avoid contact of the harsher technical face with the wearer's skin.

[1]This convention of "technical face" and "technical back" is employed throughout this patent application. It differs from the convention employed in U.S. Pat. No. 5,855,125.

Warp knitting machines can also be used to manufacture double face knit fabrics having raised surfaces on both the technical face and the technical back. In the processes described, e.g., in U.S. Pat. No. 5,855,125, the entire disclosure of which is incorporated herein by reference, some of the cut connecting yarns (pile yarns) are pulled through the fabric, from the technical back to the technical face, by a napping process, and raised to provide a raised fleece surface on the technical back. Typically, about 20% to 70% of the pile yarn is pulled through the fabric to form the fleece. The amount of pile yarn pulled through can be controlled, e.g. by adjusting the pressure applied during napping and/or by adjusting the thickness of the stitch and/or backing yarns relative to the thickness of the pile yarns. Generally, the thinner the pile yarns are relative to the stitch and backing yarns, the less pile yarn that will be pulled through.

SUMMARY

The inventor has found that fabrics having particularly desirable aesthetic properties can be produced using the methods described in U.S. Pat. No. 5,855,125 by selecting and/or arranging the pile yarns to provide a difference in appearance between the technical face and technical back of the fabric. For example, by this method, the technical face and technical back may exhibit different depths of color. The difference in appearance is provided by the selection of two or more different yarns for the pile yarns. The yarns may exhibit differences, for example, in physical differences, e.g., after heating during the dyeing process, and/or in color differences, e.g., due to differences in the amount of dye taken up by the respective yarns. The fabric structure described in U.S. Pat. No. 5,855,125 is formed by pulling some portion of the pile yarns from the technical back to the technical face.

Different pile yarns may also be blended in a single region of the fabric, and/or may be arranged or arrayed in different regions of the fabric. Using a combination of pile yarns provides distinctive aesthetic effects, and differences in appearance between the technical back and the technical face of the fabric.

According to one aspect of the invention, a method of making fabric on a double bar warp knitting machine, with the fabric having a technical face with a velour or fleece surface and a first set of appearance characteristics, and the fabric having an opposite, technical back with a pile velvet surface and a second set of appearance characteristics, the second set of appearance characteristics of the technical back being different from the first set of appearance characteristics of the technical face, comprises the steps of: selecting one or more different pile yarns to provide the fabric with the technical face having the first set of appearance characteristics and the technical back having the second set of appearance characteristics, the first set of appearance characteristics of the technical face being selected from among: depth of color upon dyeing, degree of raising, degree of air permeability, susceptibility to selected dye formulation, reaction to heat, and degree of coarseness, bulk, cross-section and/or denier; and the second set of appearance characteristics of the technical back being selected from among: depth of color upon dyeing, degree of fiber straightness, degree of fiber curl, degree of fiber shrinkage, degree of fiber crimp degree of raising, reaction to heat, degree of yarn coarseness, bulk, cross-section and/or denier; knitting a three-dimensional fabric structure on the knitting machine, the structure having two fabric substrates formed from the backing and stitch yarns, each defining a technical face, with a plurality of the pile yarns extending between and interconnecting the fabric substrates; cutting the pile yarns to separate the fabric substrates, with ends of the pile yarns extending from each fabric substrate to define a technical back; dyeing the fabric substrate; processing the technical face of the fabric substrate by pulling pile yarns from the technical back to the technical face to form the velour or fleece surface on the technical face; and processing the pile yarns at the technical back of the fabric substrate to form the velvet surface.

Preferred embodiments of this aspect of the invention may include one or more of the following additional features. The step of dyeing the fabric comprises dyeing to a solid color, and the step of selecting the pile yarns comprises selecting the pile yarns to have different dyeabilities and/or dye uptakes. The step of selecting the first set of appearance characteristics and selecting the second set of appearance characteristics comprises selecting the depth of color upon dyeing, with the first depth of color selected to be relatively lighter than the second depth of color. Preferably, the step of selecting the first set of appearance characteristics and selecting the second set of appearance characteristics comprises selecting the depth of color upon dyeing, with the first depth of color selected to be relatively darker than the second depth of color. More preferably, the step of selecting the first set of appearance characteristics and selecting the second set of appearance characteristics comprises selecting a first dye for a first set of the pile yarns and selecting a second, different dye for a second set of the pile yarns, or it comprises selecting a first material for a first set of the pile yarns and selecting a second material for a second set of the pile yarns and still more preferably comprises selecting the first material and the second material to be 100% polyester. The step of selecting the first set of appearance characteristics and selecting the second set of appearance characteristics comprises selecting a pile material to provide, upon processing, a first physical look on the technical face and a second physical look, different from the first physical look, on the technical back. Preferably, the first physical look on the technical face is velour and the second physical look on the technical back is a shearl or crimp. The step of selecting the first set of appearance characteristics and selecting the second set of appearance characteristics comprises selecting a first dye for a first set of the pile yarns and selecting a second, different dye for a second set of the pile yarns. The step of selecting the first set of appearance characteristics and selecting the second set of appearance characteristics comprises selecting a first material for a first set of the pile yarns and selecting a second material for a second set of the pile yarns. Preferably, the step of selecting the pile yarns comprises selecting the first material and the second material to be 100% polyester. The step of selecting the pile yarns comprises selecting first pile yarns having first appearance characteristics and selecting second pile yarns having second appearance characteristics different from the first appearance characteristics, and the step of knitting comprises disposing the pile yarns in a predetermined pattern comprising one or more regions of the first pile yarns having the first appearance characteristics and one or more regions of the second pile yarns having the second appearance characteristics different from the first appearance characteristics. The step of processing the pile yarns at the technical back of the fabric substrate comprises causing the velvet surface to have a pile height in the range of about 2/32-inch to about 18/32-inch. The method comprises the further step of dyeing one or more regions of the technical face by application of dye of contrasting color by wet printing techniques. The method comprises the further step of applying a chemical binder upon one or more regions of the technical face surface to create regions of enhanced surface abrasion resistance. The method comprises the further step of applying a chemical resist upon one or more regions of the technical face surface prior to the step of processing, for local resistance to napping and raising, thereby to create a predetermined pattern of regions of low or no fleece among adjacent regions of high fleece in the velour surface of the technical face. The step of selecting the pile yarns comprises selecting first pile yarns having first appearance characteristics and selecting second pile yarns having second appearance characteristics different from the first appearance characteristics, and the step of knitting comprises commingling the pile yarns to provide the fabric with a heather appearance.

According to another aspect of the invention, a fabric comprises a plurality of backing or stitch yarns cooperatively knitted together, and a plurality of pile yarns extending from each of a technical face with a velour or fleece surface and a first set of appearance characteristics, and a technical back with a velvet surface and a second set of appearance characteristics, the first set of appearance characteristics being different from the second set of appearance characteristics; and the plurality of pile yarns being processed by napping or raising, thereby forming the velour or fleece surface at the technical face and the plurality of pile yarns being processed, thereby forming the velvet surface at the technical back; the plurality of pile yarns including: first pile yarns formed of materials having the first set of appearance characteristics selected from the group of appearance characteristics consisting of: depth of color upon dyeing, degree of raising, degree of air permeability, susceptibility to selected dye formulation, reaction to heat, and degree of coarseness, bulk, cross-section and/or denier; and second pile yarns formed of materials having the second set of appearance characteristics selected from among the group of appearance characteristics consisting of: depth of color upon dyeing, degree of fiber straightness, degree of fiber curl, degree of fiber shrinkage, degree of fiber crimp degree of raising, reaction to heat, degree of yarn coarseness, bulk, cross-section and/or denier.

Preferred embodiments of this aspect of the invention may include one or more of the following additional features. The first pile yarns having a first cross-section and the second pile yarns having a second, different cross-section. Preferably, the first pile yarns have a cross-section selected from the group consisting of serrated ribbon and trilobal. The first pile yarns have a first denier and the second pile yarns have a second, different denier. The technical back and the technical face are of the same hue. The technical back and the technical face have contrasting surface textures. Preferably, technical face has a raised pile surface and the technical back has a sheared chamois or suede surface. The velvet surface of the technical back and the velour or fleece surface of the technical face have different pile heights. Preferably, the velvet surface of the technical back has a pile height in the range of about 0.06 inch to about 0.6 inch, and the velour or fleece surface of the technical face has a significantly lower pile height than the velvet surface of the technical back. The fabric is jet-dyed. The pile yarns comprise polyester, e.g. the pile yarns comprise 100% polyester yarns. One or more regions of the velour or fleece surface at the technical face have color different from a surrounding region by application of dye by wet printing techniques. One or more regions of the technical face has enhanced surface abrasion resistance by application of chemical binder. The pile yarns are disposed in a predetermined pattern comprising one or more regions of the first pile yarns having the first appearance characteristics and one or more regions of the second pile yarns having the second appearance characteristics different from the first appearance characteristics. The pile yarns are intermingled to provide the fabric with a heather appearance. The technical face defines a predetermined pattern of regions of low or no fleece among adjacent regions of high fleece in the velour or fleece surface, achieved by application of a chemical resist upon regions of the technical face prior to processing, for local resistance to napping and raising. The first pile yarns have a first set of physical properties and the second pile yarns have a second set of physical properties different from the first set of physical properties. The first pile yarns comprise a first polymer and the second pile yarns comprise a second, different polymer.

In addition to desirable aesthetic qualities, preferred fabrics may also provide a high level of thermal insulation, as the raised technical face surface tends to reduce convective heat loss.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 8A shows a partial view of fabric A4 of FIG. 7D;

FIG. 8B shows the orientation of the pile yarn of fabric A4 before stretching; and FIG. 8C shows the orientation of the pile yarn of fabric A4 after stretching.

Like reference symbols in the various drawings indicate like elements.

DETAILED DESCRIPTION

Preferred fabrics of the invention are knitted using the knitting methods described in U.S. Pat. No. 5,855,125.

Figure 1:
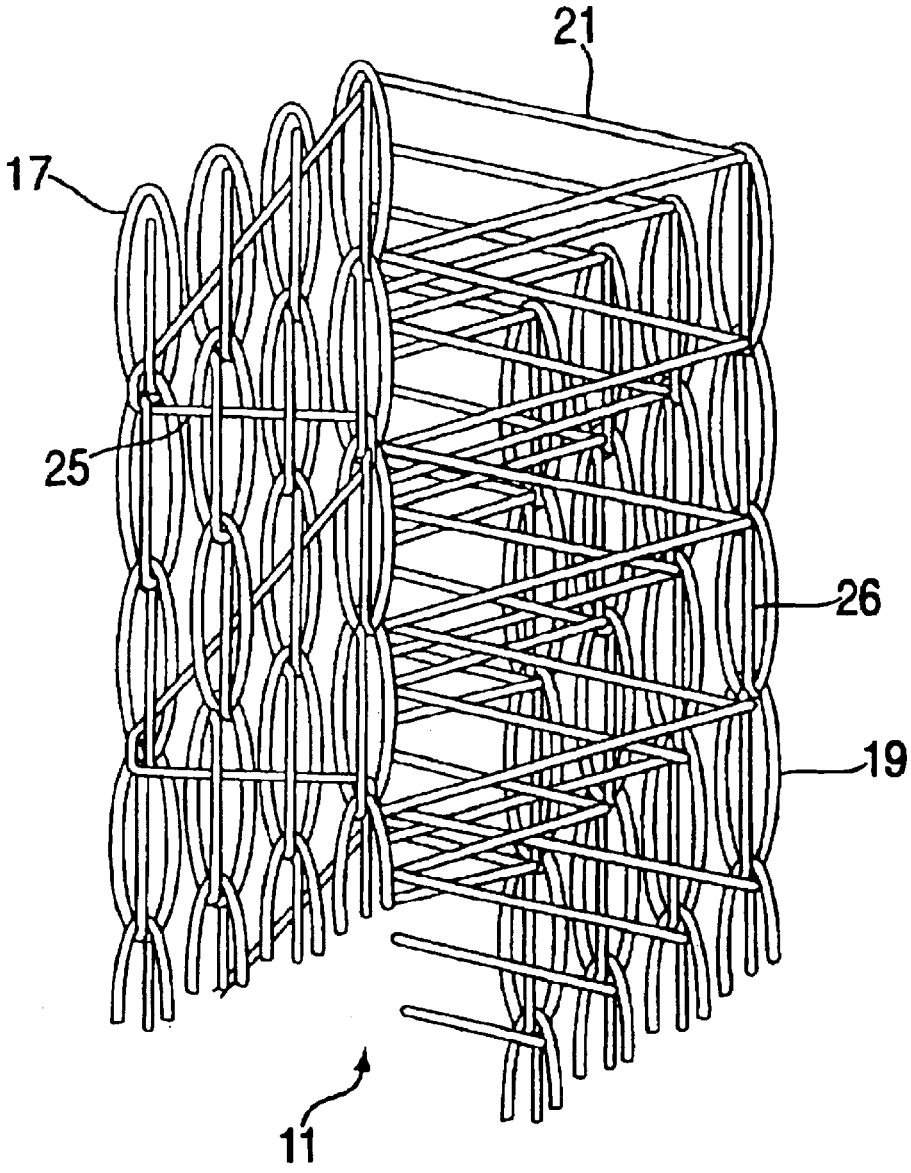
FIG. 1 is a shows a cross-sectional view of a three-dimensional fabric structure prior to splitting into two fabrics.
Figure 2:
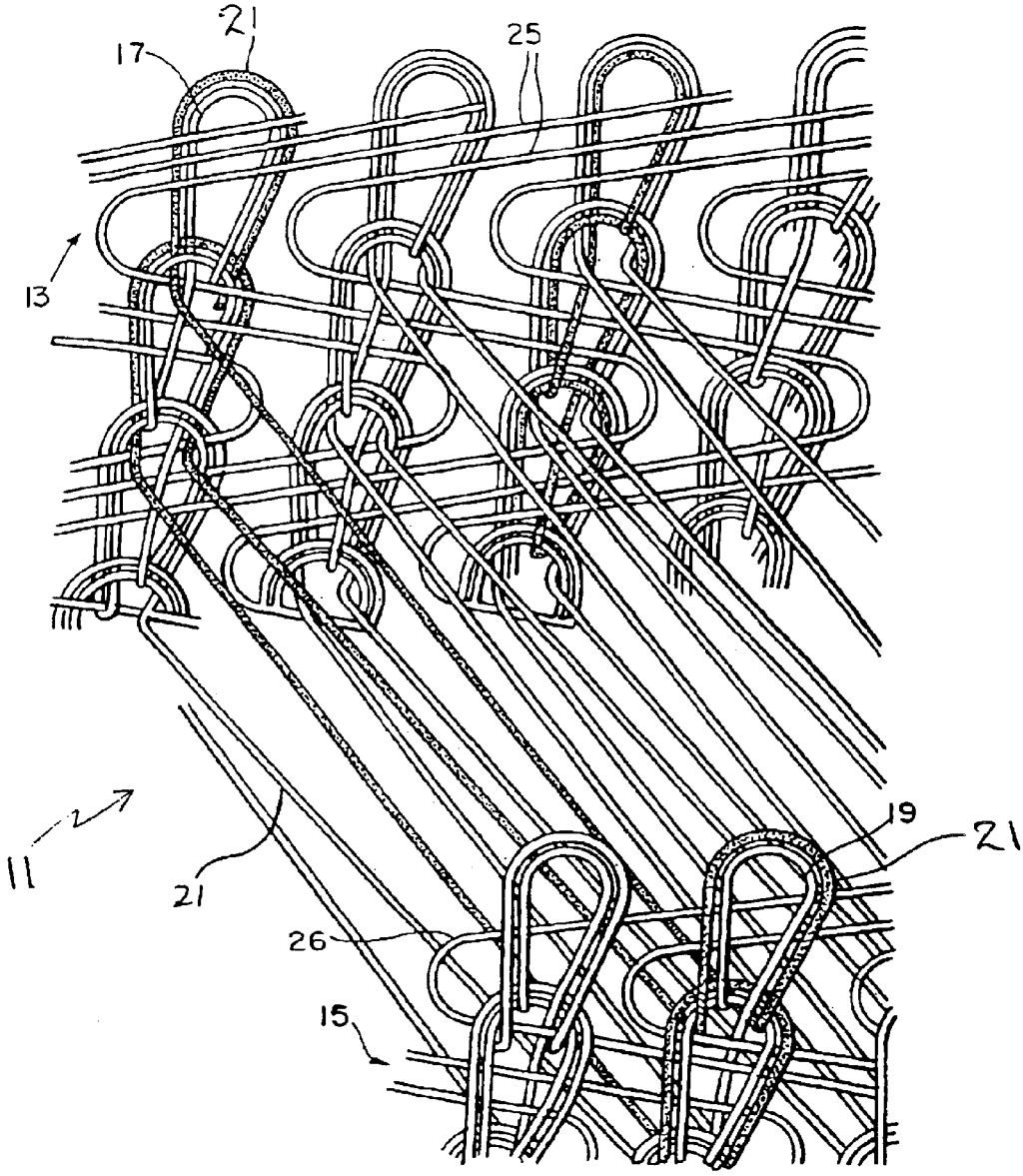
FIG. 2 is an angled side view of the three-dimensional fabric structure prior to being split into two fabrics showing the loop structure of a pile fabric produced on a double needle bar warp knitting machine.

The double face fabric of the invention is prepared by first knitting a three dimensional knit fabric on a double needle bar warp knitting machine commonly used in the manufacture of single faced velvet and well known in the art. Referring to FIGS. 1 and 2, the knitting machine is used to knit a three-dimensional fabric 11 that includes a first fabric layer 13 made from stitch yarn 17, a second fabric layer 15 made from stitch yarn 19, and pile yarn 21 interconnecting the two fabric layers. In addition, knit fabric 11 includes backing yarns 25 and 26, which are knit into stitch yarns 17 and 19, respectively. As can be appreciated from FIG. 2, pile yarn 21 is plaited at one end around stitch yarn 19 and plaited at the other end around stitch yarn 17. This plaited construction facilitates the napping process performed on the technical face of each of the fabric pieces. By plaiting the pile yarn around the stitch yarn, the stitch yarn is generally insulated from attack when napping so that substantially only the pile yarn is napped.

Significantly, it is preferred that the bulk of the pile yarn 21 be greater than that of stitch yarn 17 and 19. The stitch yarn gives dimensional stability and strength to the fabric, but does not add any aesthetic value to the fabric and thus preferably remains invisible in the finished fabric. The bulk of the pile yarn is important for imparting fullness, bulk, warmth and aesthetic value to the fabric. The bulk of the yarn is a measurement of the effective cross section of the yarn and it is a yarn characteristic well known in the art. A higher bulk ratio of pile yarn/stitch yarn enhances nappability, as well as minimizing damage and/or breakage of the stitch yarn during napping. When the bulk ratio is high, the pile yarn will tend to physically protect the stitch yarn during the napping process. A bulk ratio of at least 1.5:1 is preferred, e.g. about 3:1. Bulk and loftiness may be given to the fabric without adding weight by using textured pile yarns versus flat yarns.

Figure 3:
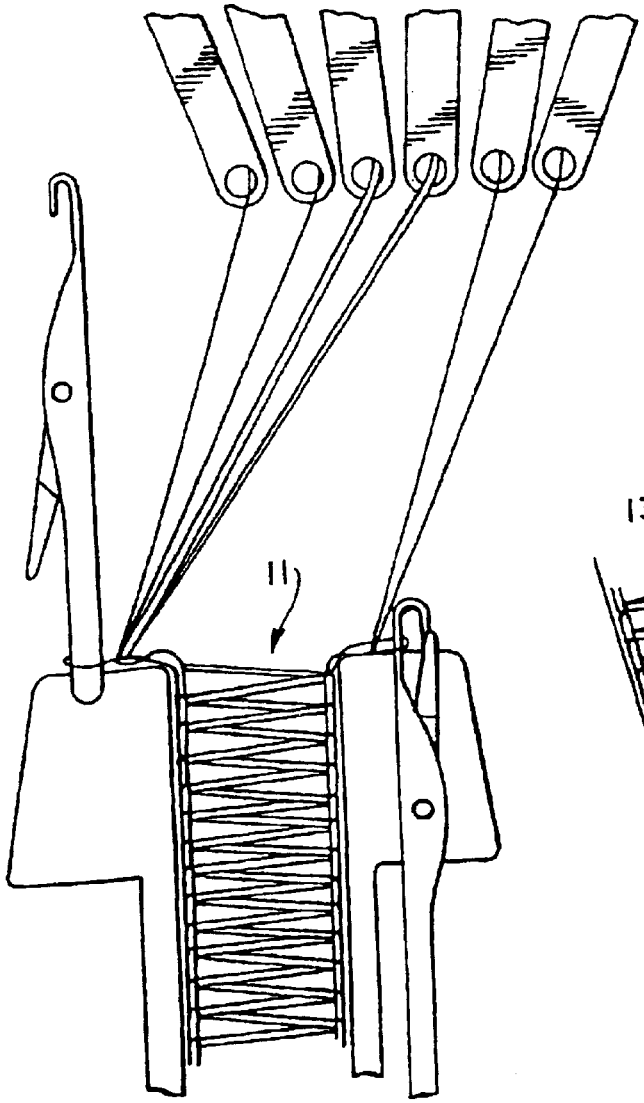
FIG. 3 is a side view of double needle bar raschel machine knitting a three-dimensional fabric.
Figure 4:
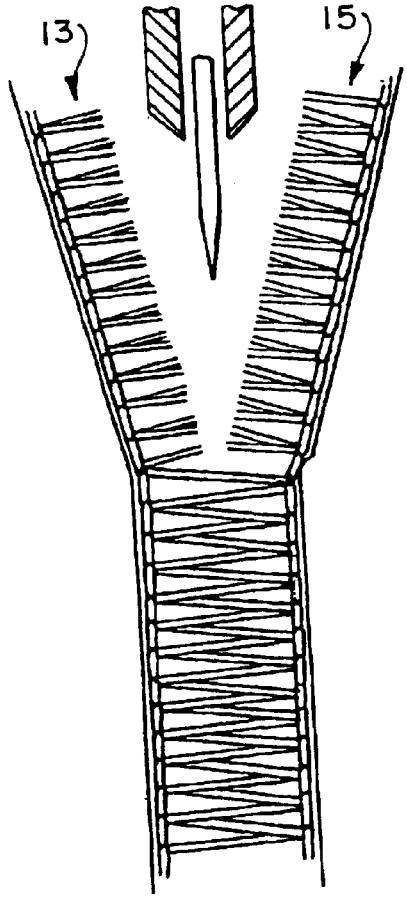
FIG. 4 is a side view of the three-dimensional fabric being split into two fabrics.

After producing the three-dimensional knit fabric 11, the pile yarn 21 connecting the two layers 13 and 15 is cut with a splitter (FIGS. 3 and 4) to form two intermediate fabrics 13, 15, each having a velvet surface on the technical back (the side that is cut) and a flat surface or jersey surface on the technical face, which is then treated to form a fleece as described below.

Each resulting fabric 13, 15 has a velvet side and a fleece side. On the velvet side (technical back), the tufts of the pile yarn protrude from the support fabric in wales and courses. The tufts are arranged horizontally (courses) and vertically (wales) in rows with some distance between them in both directions of the fabric. On the fleece or velour side (technical back), the fibers are not arranged in tufts and rows because the fiber ends are randomly pulled out of the pile yarn by the napper wire and distributed evenly over the napped fabric to form a fleece. The fleece side of the fabric may have, e.g., 30 to 50% of the pile fibers, while the velvet side of the fabric has the remaining 50% to 70% of the pile fibers. These relative percentages can be changed according to the end use and application of the fabric. If the fleece or velour side (technical face) of the fabric is the outside surface of a garment, it can be made to look fuller and richer by pulling 50% or more of the pile to the napped side. If the velvet side (technical back) is the outside surface of the garment, 10% to 20% or less of the fibers may be pulled to the fleece side of the fabric. This leaves the velvet side fuller, and leaves the patterns clearer and better defined.

Each fabric piece 13,15 is then dyed in a jet-dyeing machine, i.e., a textile dyeing process that directs jet streams of dyeing liquid at a textile to provide deep penetration of the dye material into the fibers of the fabric. The dyeing liquid is prepared using one or more suitable dyestuffs, e.g., using conventional methods. Dyestuffs include direct dyes, reactive dyes, sulfur dyes, etc. The process typically involves circulation of a rope of fabric through a dye bath under the influence of a rapidly moving jetted portion of the liquid dye bath. Jet dyeing allows the dye to be brought into contact with the fabric under selected temperature and pressure conditions. In one embodiment, the jets strike the rope of polyester fabric at an angle of 45° or greater and a temperature of about 265° F. (about 130° C.). The kinetic energy of the jet serves to force the dye into the fabric fibers and circulates the rope of fabric through the dye bath.

Figure 5:
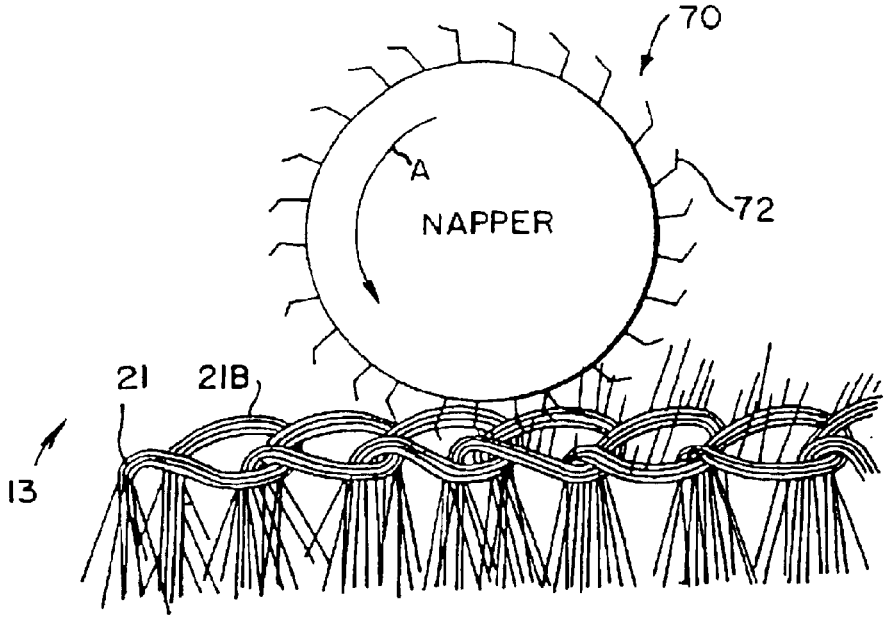
FIG. 5 is a somewhat schematic side view of a napping process.

The technical face of the jet-dyed fabric is napped to create the finished surface of the fabric. For this purpose, a standard napper can be used. Referring to FIG. 5, a fabric is shown being napped by a napper graphically represented by a cylinder 70. Cylinder 70 is rotated in the direction indicated by arrow A and provided with a plurality of angled wire fingers 72. Importantly, as can be seen in FIG. 5, the direction of rotation of cylinder 70 and the orientation of fingers 72 is such that the fabric 13 is napped in the direction of the loops 21A of the pile yarns 21. (In FIG. 5, the substrate has been omitted for the sake of clarity.)

Figure 6A:
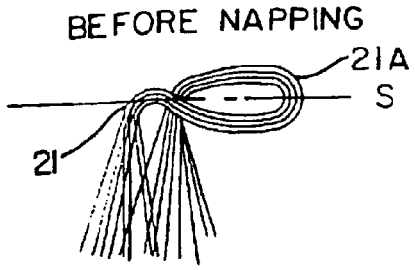
FIGS. 6A and 6B are somewhat diagrammatic side views of a typical pile yarn loop before and after the napping process, respectively.
Figure 6B:
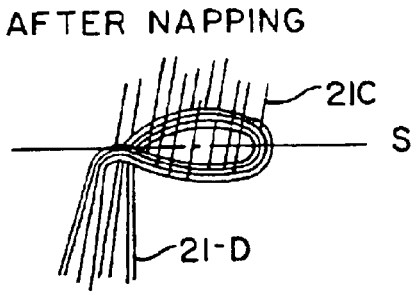

As a result of the napping, a predetermined percentage of the fibers of the pile yarns 21 are physically pulled through the substrate, as illustrated in FIGS. 6A and 6B. In FIG. 6A, a typical loop 21A is shown on a pile yarn 21. The free ends of the fibers of yarn 21 extend in the same direction (in FIG. 6A, downward) away from and along one side of the substrate S. However, after napping, as shown in FIG. 6B, some of the fibers 21C have been pulled through the substrate S so that they are now disposed on the technical face, while other fibers 21D remain on the technical back of the fabric. The percentage of fibers pulled through the substrate is dependent on a number of factors, such as napper speed and tension, and the speed and tension of the fabric. Thus this percentage may be adjusted, e.g., by adjusting these parameters, so that between 20% and 80% of the fibers are pulled through the substrate.

Preferably, for each fabric piece, after the flat knit surface is raised, the raised surface is cleaned of loose fibers, e.g., by additional brushing or napping, and sheared to even the pile height. Each resulting fabric piece has a velvet surface on one side and a raised fleece surface that is non-pilling functional velour on the other side.

A contrasting appearance between technical face and technical back is obtained by selecting two or more different pile yarns that have different physical properties, e.g. different cross-sections, denier, surface textures, etc. The different properties of the pile yarns cause the yarns to respond differently to processing, e.g., dyeing, heat-treating, napping operations, etc.

The pile yarns are selected to provide the fabric with a technical face having a first set of appearance characteristics and a technical back having a second set of appearance characteristics different from the first set of appearance characteristics. Each set of appearance characteristics may be selected, e.g., from among the following: depth of color upon dyeing, degree of raising, degree of air permeability, susceptibility to selected dye formulation, reaction to heat, and degree of coarseness, bulk, cross-section and/or denier.

The degree to which the technical face contrasts with the technical back, and thus the aesthetic effect obtained, can be readily manipulated by altering the percentage of pile yarns pulled through the fabric base during napping. Thus, if a high degree of contrast is desired, a lower percentage of pile yarns will be pulled through the base, while if a lower degree of contrast is desired, a higher percentage of pile yarns will be pulled through.

The pile yarns may include yarns having different dyeability, e.g., yarns formed of dispersion dyeable polyester and/or yarns formed of cationic dyeable polyester.

The pile yarns may also include mixtures of yarns having different physical properties, e.g., cross-section, dyeability, denier, and/or shrinkage when heated during dyeing. The difference in physical properties will cause the yarns to react differently to the heat of the dyeing process, which will generally result in the yarns being dyed to relatively different depths of color and/or having relatively different physical appearances after dyeing.

For example, the pile yarns may include one or more of the following:

(1) 212/94 FF (flat filament), T-659 serrated ribbon cross section. These polyester yarns will remain straight under the heat of dyeing, and will generate a high luster and a high bulk-to-weight ratio with very good resiliency.

(2) 200/100 FF (flat filament), T-840 Hoy yarn, trilobal cross section. These polyester yarns will curl under the heat of dyeing, and will dye to a relatively dark hue.

(3) 2/70/200 tx, textured yarn, round cross section. These polyester yarns will shrink under the heat of dyeing. They will also dye to a relatively lighter hue, as compared to the yarns of examples (1) and (2) above.

(4) 150/68 textured yarn. The polyester yarns will shrink and generate a crimped look under the heat of dyeing.

The pile yarns, backing yarns and stitch yarns can all be formed of the same polymer, for example, 100% polyester. Alternatively, the pile yarns and the backing and/or stitch yarns may be formed of different polymers. In some embodiments, for example, the pile yarn is a 100% polyester yarn and the backing and stitch yarns are nylon yarns. Moreover, the fabric may include combinations of pile yarns formed of different polymers, e.g., polyester pile yarns and nylon pile yarns. In all cases, the technical face of the fabric will have a velour look after napping.

The different pile yarns can be used individually in different regions of the fabric in distinctive patterns, e.g., with separate groupings of dispersion dyeable polyester and cationic dyeable polyester, or commingled to get a heather look. The pile yarns may also be commingled in different ratios or blends in different regions of the fabric, to combine the aesthetic effect of commingling with that of patterns formed of discrete regions. If different pile yarns are commingled, the level of commingling (tuck/meter) can be varied to obtain a desired appearance.

For example, a fabric may include a band of 100% polyester pile yarns with 200/100 FF, a trilobal cross section and tenacity of 3 gpd, and bands of 100% polyester pile yarns with 212/94 FF and a flat, serrated cross section. The resulting fabric has stripes of shearl and stripes of straight pile on its technical back, and relatively uniform velour of the technical face without noticeable bands. Similarly, combinations of the 212/94 FF, T-659 yarns discussed above with 2/70/200 tx textured yarns having a round cross-section will form sections of straight yarn having a relatively dark hue (212/94 FF, T-659) and sections of relatively lower pile height and lighter hue (2/70/200 tx). Other patterns can also be created, e.g., squares, rectangles, argyle, etc. Moreover, different textures can be used in a variety of patterns. For example, a pattern may incorporate 1 to 4, or more, different types of polyesters.

In some implementations, the technical face of the fabric may be coated or impregnated with a coating or binder to provide desired technical and/or aesthetic properties. For example, the technical face may be coated with acrylic latex, silicone or polyurethane to improve abrasion resistance and reduce pilling. Abrasion resistance may be tested using modified Martindale abrasion testing in which a patch of VELCRO® hook material is rubbed against the technical face.

The coating or binder may be applied to the technical face in a pattern or design that will resist raising during the napping process, to provide the finished technical face with a pattern of raised and non-raised areas, e.g., in an aesthetically appealing design. The fabric can also be printed, e.g., with a wet printing process, to impart a desired colored pattern or design to the technical face.

FIGS. 7A through 7E show various knits that may be used in the present invention. These knits are hereinafter referred to as A1 . . . A5 respectively. If a more stable fabric is required, or if stretch and some texture are needed, knit constructions A2, A3 and A4 should be used.

The front support fabric is formed with the two outside yarn guide bars 1 and 2 on the front needle bar. The back support fabric is formed with the two other outside yarn guide bars 5 and 6 on the back needle bar on a 6 guide bar machine. Guide bars 6 and 7 and the back needle bar form the support fabric on a 7-guide bar machine. To anyone familiar with the art of warp knitting, it is obvious that a large variety of knits, forming the support fabric, can be constructed with two yarn guide bars and a needle bar.

Knits A1 to A5 are but a small sampling of possible knits. The fabric produced with knit A1 is a stable fabric with little stretch in both directions. By modifying the knit as shown in A2, a fabric with 40% to 50% stretch in the horizontal direction can be produced. By changing the same knit further as seen in A3, an additional stretch of 10% to 20% in vertical direction is made possible. Knits A4 and A5 are mesh type knits and can be stretched up to 100% of their original width (i.e., the width of the fabric can be doubled). Stretch in these types of fabrics has great importance. Fabrics of standard width are produced on standard equipment for different end uses. The fabric is then stretched to the required width or length in either direction on a tenter frame. After stretching, the fabric is stabilized by heat setting. Napping of the pile yarns is performed prior to the stretching. The new width can increase the original width by up to 100%.

An important feature of the knits A1 to A5 is that they can be stretched to produce very unique distinct decorative patterns. This feature is best illustrated by knit fabric A4. Referring to FIG. 8A, it can be seen that the knit fabric A4 is structured so that some of the wales are connected (see wales 1, 2, 3, 7, 8, 9 . . . ) while other wales (4, 5, 6, 10, 11, 12 . . . ) are not connected. This structure allows the wales not connected to each other to separate as the knit fabric A4 is stretched sideways. Referring now to FIG. 8B, it can be seen that before stretching, the pile yarns forming the velvet, i.e. on the technical face, all extend substantially vertically and parallel to each other. As previously discussed, the pile yarns are plaited around the substrate by loops, as seen in FIGS. 2, 7, 8A, 8B and 8C. Generally, there are three sets of pile yarns. Two sets are associated with the connected wales and the third set with the unconnected wales. As the knit fabric A4 is stretched sideways, the pile yarn loops associated with connected wales are pulled sideways forcing the free ends or tips 21D of the pile yarn to bend either in one direction or another as they are pulled partially onto the substrate. However, the yarns associated with the unconnected wales remain substantially vertical, as shown in FIG. 8C. The net result is that the straight pile yarns extend higher than the bent pile yarns, thus creating various patterns in the base or substrate. Upon stretching the fabric, the pile yarns form corresponding three dimensional patterns.

Figure 7A:
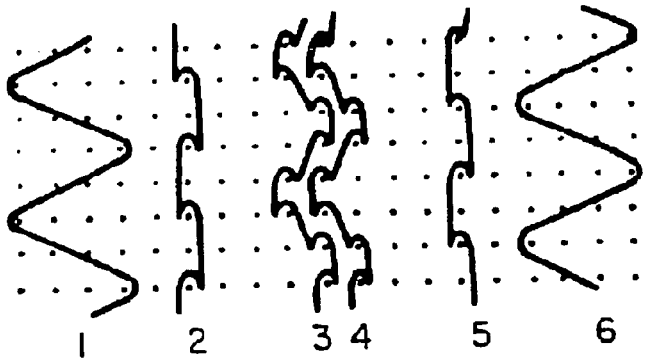
FIGS. 7A through 7E show various knits that may be used for the subject invention.
Figure 7B:
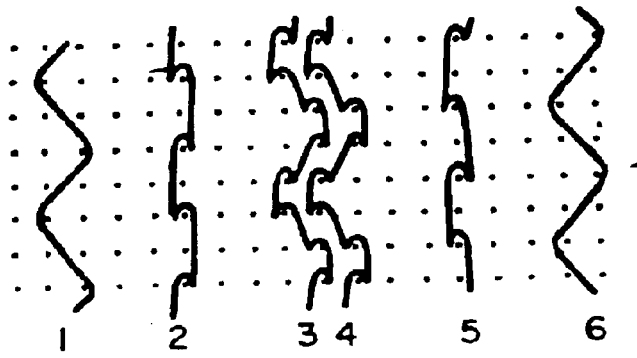
Figure 7C:
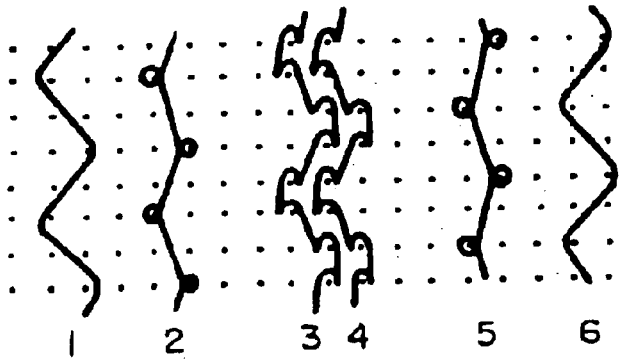
Figure 7D:
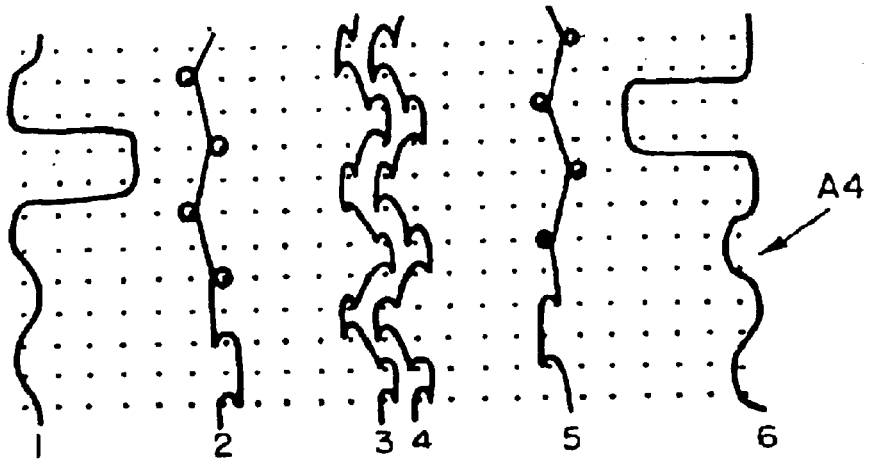
Figure 7E:
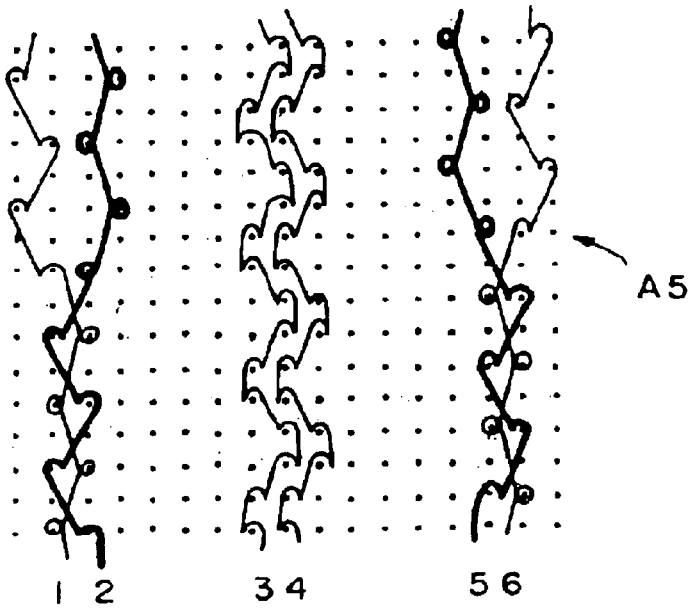

As seen in FIG. 7D, as the fabric is stretched, the separation between the wales is 3 stitches long. In the finished fabric, these openings are covered on both sides with pile and they are only visible when the fabric is held up to the light. This separation makes the fabric light and lofty, while at the same time the fabric retains its bulk.

Knit A5 (FIG. 7E) is another of many mesh fabrics that can be produced with two guide bars and one needle bar, especially if the yarn guide bars 1, 2 and 6, 7 respectively have a "one in, one out" threading (1/1), or a "two in, two out" threading (2/2). Both bars can also have variable threading to produce different types of texture. When a fabric with this knit is stretched in width direction, the wales that are not connected to each other will separate to form openings larger than in knit A4, thereby to produce a texture of different fiber densities on both side of the fabric.

A number of embodiments of the invention have been described. Nevertheless, it will be understood that various modifications may be made without departing from the scope of the invention. Accordingly, other embodiments are within the scope of the following claims.

What is claimed is:

1. A method of making fabric on a double bar warp knitting machine, with the fabric having a technical face with a velour or fleece surface and a first set of appearance characteristics, and the fabric having an opposite, technical back with a pile velvet surface and a second set of appearance characteristics, the second set of appearance characteristics of the technical back being different from the first set of appearance characteristics of the technical face, said method comprising the steps of:

selecting one or more different pile yarns to provide the fabric with the technical face having the first set of appearance characteristics and the technical back having the second set of appearance characteristics, the first set of appearance characteristics of the technical face selected from among: depth of color upon dyeing, degree of raising, degree of air permeability, susceptibility to selected dye formulation, reaction to heat, and degree of coarseness, bulk, cross-section and/or denier; and the second set of appearance characteristics of the technical back selected from among: depth of color upon dyeing, degree of fiber straightness, degree of fiber curl, degree of fiber shrinkage, degree of fiber crimp degree of raising, reaction to heat, degree of yarn coarseness, bulk, cross-section and/or denier;

knitting a three-dimensional fabric structure on the knitting machine, said structure having two fabric substrates formed from the backing and stitch yarns, each defining a technical face, with a plurality of the pile yarns extending between and interconnecting the fabric substrates;

cutting the pile yarns to separate the fabric substrates, with ends of the pile yarns extending from each fabric substrate to define a technical back;

dyeing the fabric substrate;

processing the technical face of the fabric substrate by pulling pile yarns from the technical back to the technical face to form the velour or fleece surface on the technical face; and processing the pile yarns at the technical back of the fabric substrate to form the velvet surface.

2. The method of making a fabric of claim 1, wherein the step of dyeing the fabric comprises dyeing to a solid color, and the step of selecting the pile yarns comprises selecting the pile yarns to have different dyeabilities and/or dye uptakes.

3. The method of making a fabric of claim 1 or 2, wherein the step of selecting the first set of appearance characteristics and selecting the second set of appearance characteristics comprises selecting the depth of color upon dyeing, with the first depth of color selected to be relatively lighter than the second depth of color.

4. The method of making a fabric of claim 3, wherein the step of selecting the first set of appearance characteristics and selecting the second set of appearance characteristics comprises selecting the depth of color upon dyeing, with the first depth of color selected to be relatively darker than the second depth of color.

5. The method of making a fabric of claim 4, wherein the step of selecting the first set of appearance characteristics and selecting the second set of appearance characteristics comprises selecting a first dye for a first set of the pile yarns and selecting a second, different dye for a second set of the pile yarns.

6. The method of making a fabric of claim 4, wherein the step of selecting the first set of appearance characteristics and selecting the second set of appearance characteristics comprises selecting a first material for a first set of the pile yarns and selecting a second material for a second set of the pile yarns.

7. The method of making a fabric of claim 6, wherein the step of selecting the pile yarns comprises selecting the first material and the second material to be 100% polyester.

8. The method of making a fabric of claim 4, wherein the step of selecting the first set of appearance characteristics and selecting the second set of appearance characteristics comprises selecting a pile material to provide, upon processing, a first physical look on the technical face and a second physical look, different from the first physical look, on the technical back.

9. The method of making a fabric of claim 8, wherein the first physical look on the technical face is a velour and the second physical look on the technical back is a shearl or crimp.

10. The method of making a fabric of claim 4, wherein the step of selecting the first set of appearance characteristics and selecting the second set of appearance characteristics comprises selecting a first dye for a first set of the pile yarns and selecting a second, different dye for a second set of the pile yarns.

11. The method of making a fabric of claim 4, wherein the step of selecting the first set of appearance characteristics and selecting the second set of appearance characteristics comprises selecting a first material for a first set of the pile yarns and selecting a second material for a second set of the pile yarns.

12. The method of making a fabric of claim 11, wherein the step of selecting the pile yarns comprises selecting the first material and the second material to be 100% polyester.

13. The method of making a fabric of claim 1, wherein the step of selecting the pile yarns comprises selecting first pile yarns having first appearance characteristics and selecting second pile yarns having second appearance characteristics different from the first appearance characteristics, and the step of knitting comprises disposing the pile yarns in a predetermined pattern comprising one or more regions of the first pile yarns having the first appearance characteristics and one or more regions of the second pile yarns having the second appearance characteristics different from the first appearance characteristics.

14. The method of making a fabric of claim 1, wherein the step of processing the pile yarns at the technical back of the fabric substrate comprises causing the velvet surface to have a pile height in the range of about 2/32-inch to about 18/32-inch.

15. The method of making a fabric of claim 1, comprising the further step of dyeing one or more regions of the technical face by application of dye of contrasting color by wet printing techniques.

16. The method of making a fabric of claim 1, comprising the further step of applying a chemical binder upon one or more regions of the technical face surface to create regions of enhanced surface abrasion resistance.

17. The method of making a fabric of claim 1, comprising the further step of applying a chemical resist upon one or more regions of the technical face surface prior to the step of processing, for local resistance to napping and raising, thereby to create a predetermined pattern of regions of low or no fleece among adjacent regions of high fleece in the velour surface of the technical face.

18. The method of making a fabric of claim 1 or 13, wherein the step of selecting the pile yarns comprises selecting first pile yarns having first appearance characteristics and selecting second pile yarns having second appearance characteristics different from the first appearance characteristics, and the step of knitting comprises commingling the pile yarns to provide the fabric with a heather appearance.

19. A fabric comprising a plurality of backing or stitch yarns cooperatively knitted together, and a plurality of pile yarns extending from each of:

a technical face with a velour or fleece surface and a first set of appearance characteristics, and a technical back with a velvet surface and a second set of appearance characteristics, said first set of appearance characteristics being different from said second set of appearance characteristics; and the plurality of pile yarns being processed by napping or raising, thereby forming the velour or fleece surface at said technical face and the plurality of pile yarns being processed, thereby forming the velvet surface at said technical back;

the plurality of pile yarns including:

first pile yarns formed of materials having said first set of appearance characteristics selected from the group of appearance characteristics consisting of: depth of color upon dyeing, degree of raising, degree of air permeability, susceptibility to selected dye formulation, reaction to heat, and degree of coarseness, bulk, cross-section and/or denier; and second pile yarns formed of materials having said second set of appearance characteristics selected from among the group of appearance characteristics consisting of: depth of color upon dyeing, degree of fiber straightness, degree of fiber curl, degree of fiber shrinkage, degree of fiber crimp degree of raising, reaction to heat, degree of yarn coarseness, bulk, cross-section and/or denier.

20. The fabric of claim 19, wherein said first pile yarns having a first cross-section and said second pile yarns having a second, different cross-section.

21. The fabric of claim 20, wherein said first pile yarns have a cross-section selected from the group consisting of serrated ribbon and trilobal.

22. The fabric of claim 19, wherein said first pile yarns have a first denier and said second pile yarns have a second, different denier.

23. The fabric of claim 19, wherein said technical back and said technical face are of the same hue.

24. The fabric of claim 19, wherein said technical back and said technical face have contrasting surface textures.

25. The fabric of claim 24, wherein said technical face has a raised pile surface and said technical back has a sheared chamois or suede surface.

26. The fabric of claim 19, wherein said velvet surface of said technical back and said velour or fleece surface of said technical face have different pile heights.

27. The fabric of claim 26, wherein said velvet surface of said technical back has a pile height in the range of about 0.06 inch to about 0.6 inch, and said velour or fleece surface of said technical face has a significantly lower pile height than said velvet surface of said technical back.

28. The fabric of claim 19, wherein said fabric is jet-dyed.

29. The fabric of claim 19, wherein said pile yarns comprise polyester.

30. The fabric of claim 19, wherein said pile yarns comprise 100% polyester yarns.

31. The fabric of claim 19, wherein one or more regions of said velour or fleece surface at said technical face have color different from a surrounding region by application of dye by wet printing techniques.

32. The fabric of claim 19, wherein one or more regions of said technical face has enhanced surface abrasion resistance by application of chemical binder.

33. The fabric of claim 19, wherein the pile yarns are disposed in a predetermined pattern comprising one or more regions of the first pile yarns having the first appearance characteristics and one or more regions of the second pile yarns having the second appearance characteristics different from the first appearance characteristics.

34. The fabric of claim 19 or 33, wherein the pile yarns are intermingled to provide the fabric with a heather appearance.

35. The fabric of claim 19, wherein said technical face defines a predetermined pattern of regions of low or no fleece among adjacent regions of high fleece in said velour or fleece surface, achieved by application of a chemical resist upon regions of said technical face prior to processing, for local resistance to napping and raising.

36. The fabric of claim 19, wherein the first pile yarns have a first set of physical properties and the second pile yarns have a second set of physical properties different from said first set of physical properties.

37. The fabric of claim 19, wherein the first pile yarns comprise a first polymer and the second pile yarns comprise a second, different polymer.

* * * * *